US005818159A

United States Patent [19]

Dossot et al.

[11] Patent Number: 5,818,159

[45] Date of Patent: Oct. 6, 1998

[54] ELECTRON BEAM DEFLECTION SYSTEM FOR A CATHODE RAY TUBE

[75] Inventors: Alain Dossot, Saint Sauveur; Christophe Mathey; Alain Vougny, both of Dijon, all of France

[73] Assignee: Thomson Tubes and Displays, S.A., Cedex, France

[21] Appl. No.: 807,844

[22] Filed: Feb. 26, 1997

[51] Int. Cl.[6] ..... H01J 29/82; H01J 29/76

[52] U.S. Cl. ..... 313/440; 335/210; 335/213; 335/214

[58] Field of Search ..... 313/440; 335/210, 335/213, 214; 348/829, 830, 833

[56] References Cited

U.S. PATENT DOCUMENTS 4,096,531 6/1978 Yamada et al. ..... 358/248
5,557,165 9/1996 Descombes et al. ..... 313/440
5,589,729 12/1996 Descombes et al. ..... 313/440

FOREIGN PATENT DOCUMENTS 0660365 6/1995 European Pat. Off. .
0690470 1/1996 European Pat. Off. .
0690471 1/1996 European Pat. Off. .
2353951 12/1977 France .

*Primary Examiner*—Nimeshkumar Patel
*Attorney, Agent, or Firm*—Joseph S. Tripoli; Joseph J. Laks; Sammy S. Henig

[57] ABSTRACT

A deflection yoke for a cathode-ray tube, includes a pair of vertical deflection coils, a pair of horizontal deflection coils and a rigid separator insulating the pairs of deflection coils from each other. The separator has on its surface an arrangement for positioning and holding in place front and rear parts of saddle-shaped deflection coils. The arrangement forms an integral part of a body of the separator and is produced when molding the body.

13 Claims, 5 Drawing Sheets

ELECTRON BEAM DEFLECTION SYSTEM FOR A CATHODE RAY TUBE

The invention relates to an electron-beam deflection yoke for a cathode-ray tube and more particularly to the device which provides both the support for the deflection coils and the mechanical rigidity of the system.

A deflection yoke generally includes a pair of vertical deflection coils, a pair of horizontal deflection coils and a substantially frustoconical ring made of magnetic material which is intended to concentrate the flux created by the coils. The two pairs of deflection coils are electrically isolated from each other by an insulator or a separator, generally made of plastic, which furthermore makes it possible to fix the position of the coils with respect to each other and to adjust the assembly on the neck of the tube. The separator consists of a main body, composed of one or more parts, substantially in the form of a funnel, and of a flexible rear part matching the contour of the neck of the tube and intended to fix the position of the deflection system with respect to the longitudinal axis of the tube; this fixing is generally accomplished by means of a clamping clip located around the flexible rear part.

When assembling the constituent elements of the deflection yoke, the deflection coils are installed on the separator and adjusted, in terms of their position with respect to one another, so as to generate the vertical and horizontal deflection fields.

After positioning the coils, they must be fixed in a final or permanent manner, in a subsequent step, for example by adhesively bonding them to the body of the separator. A problem exists in maintaining the relative positioning of the coils unchanged on the separator between the time when the adjustment is made and the time when the coils are permanently fixed to the separator.

In the case, for example, of saddle-shaped vertical deflection coils, it is known to fix the front of the coils by attaching the coil onto the front of the separator using clamping technique. The rear parts are placed in position using an adhesive which goes around the rear parts. This method causes two problems:

the attachment onto the front part of the coil does not guarantee that this front part is absolutely prevented from rotating;

because of the manufacturing tolerances, the internal surface of the rear part of each coil has a slightly greater radius than the external surface of the separator. Using an adhesive to hold the coils in place does not guarantee that the initial adjustment will be preserved, hence a loss of precision with respect to this adjustment and a disparity in the characteristics of the deflection yokes manufactured according to this method.

The invention aims to overcome these problems by means of a deflection yoke which comprises a separator enabling the saddle-shaped deflection coils to be held in position once this position has been adjusted, until the final fixing of the coils to the separator, for example by adhesive bonding. To do this, the deflection yoke according to the invention comprises a pair of vertical deflection coils, a pair of horizontal deflection coils, at least one of these two pairs being saddle-shaped, a rigid separator insulating the pairs of deflection coils from each other and a ring made of ferromagnetic material of substantially frustoconical shape arranged above at least part of the deflection coils. One of the pairs of saddle-shaped deflection coils is applied against the body of the separator and is held in place, both on its front part and on its rear part, using an arrangement for positioning the coils and for holding them in place. Advantageously, the arrangement forms an integral part of the body of the separator. The arrangement includes a projecting member or rib projecting through a winding window formed in the corresponding coil.

A deflection yoke embodying an aspect of the invention includes a first pair of saddle shaped deflection coils. A given coil thereof has a pair of conductor bundles extending between a rear end and a front end of the deflection yoke and forming a winding window therebetween free of conductors. A second pair of deflection coils produce a deflection field having a direction that is different from that produced by the first pair of deflection coils. A magnetic core is magnetically coupled to the deflection coils. A separator separates the first and second pairs of deflection coils. The separator has a surface for supporting the first pair of deflection coils and includes a projecting member extending laterally between the pair of conductor bundles. The projecting member projects from the surface and is received in the winding window in a manner to engage in a lateral direction a conductor bundle of the pair of conductor bundles of the given coil of the first pair of deflection coils.

A deflection yoke embodying another inventive feature includes a first pair of saddle shaped deflection coils. A given coil thereof has a pair of conductor bundles extending between a rear end and a front end of the deflection yoke. A second pair of deflection coils produces a deflection field having a direction that is different from that produced by the first pair of deflection coils. A magnetic core is magnetically coupled to the deflection coils. A separator separates the first and second pairs of deflection coils having a surface for supporting the first pair of deflection coils. The separator includes a wall spaced from the surface of the separator and forming an integral part of a rear portion of the separator for receiving a rear portion of at least one of the first pair of deflection coils between the wall and the surface at the rear portion.

Figure 1:
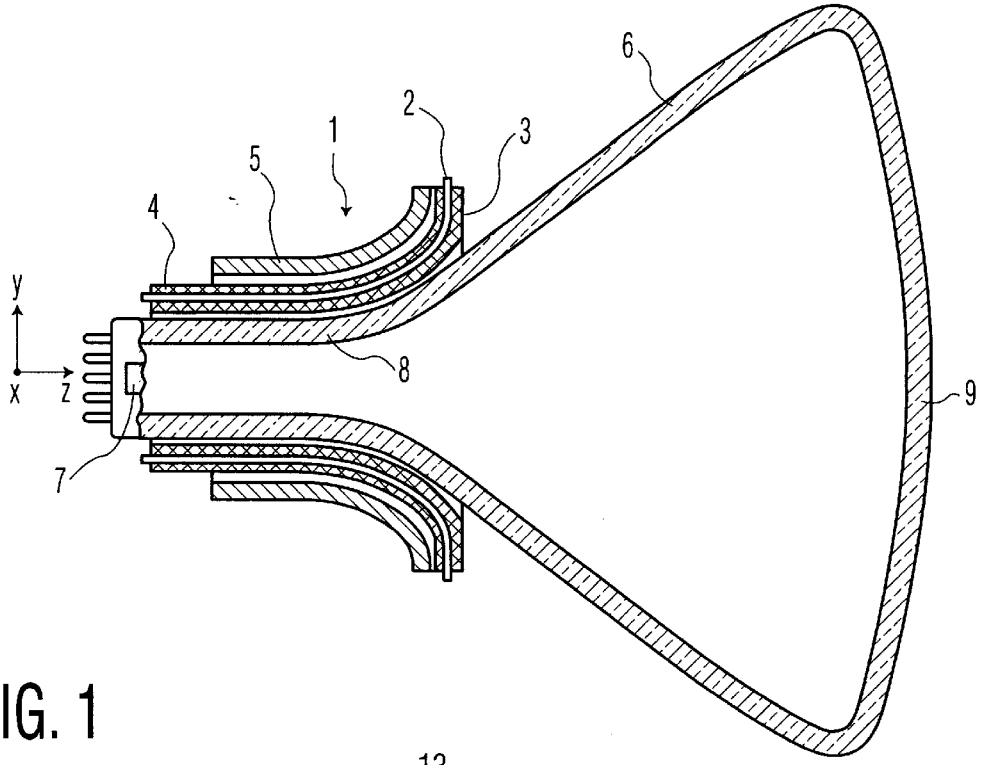
FIG. 1 illustrates a longitudinal section of a cathode-ray tube, on the neck of which is installed an electron-beam deflection yoke.

FIG. 1 shows a deflection yoke, which comprises a pair of saddle-shaped horizontal deflection coils 3, a pair of likewise saddle-shaped vertical deflection coils 4, this pair being isolated from the previous one by a separator 2; and a ring 5 made of ferromagnetic material placed around the coils 3 and 4. The assembly is placed over the neck 8 of a cathode-ray tube 6, of principal axis Z, so as to deflect the electron beams coming from the gun 7 along the direction of the X and Y axes so that they scan the screen surface 9 of the tube.

When assembling the constituent elements of the deflection yoke, the deflection coils are placed on the body of the separator and their relative positioning is adjusted precisely so as to generate deflection fields of the desired directions. Once this adjustment has been accomplished, the coils must remain in place until the subsequent step of final immobilization on the separator, which step is generally performed by adhesively bonding the coils to the body of the separator.

Figure 2:
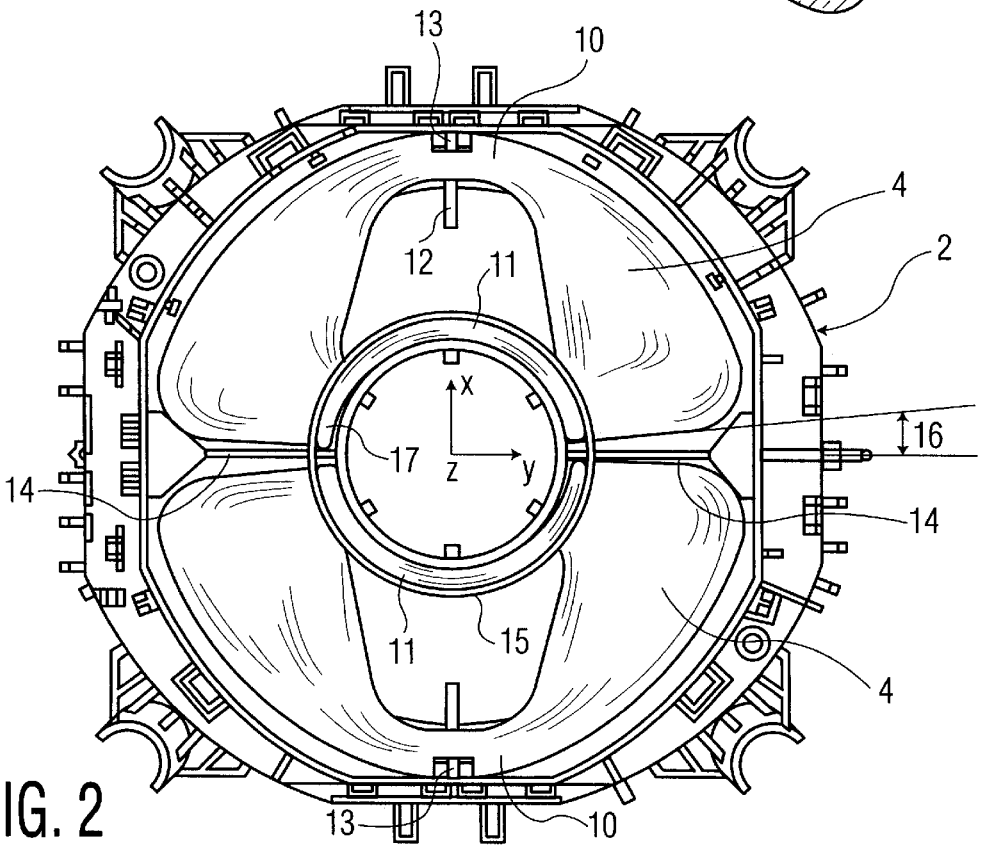
FIG. 2 PRIOR ART
FIG. 2 illustrates a view from the rear of a deflection yoke according to the prior art.
Figure 3:
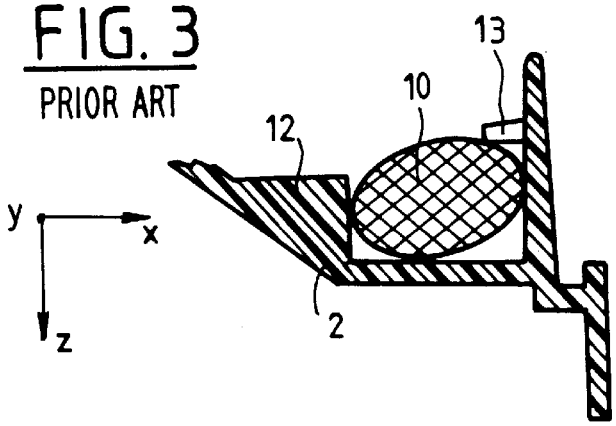
FIG. 3 PRIOR ART
FIG. 3 illustrates a cross-section of the front part of the separator having an arrangement for holding in position the front part of a saddle-shaped coil according to the prior art.

FIGS. 2 and 3 show how, in the prior art, the vertical deflection coils 4 are held in position on the separator 2. The front 10 of the coils is inserted into the housing formed by the wall of the separator, at least one peg 13 holding the front of the coils and keeping them in position with respect to the Z axis, while a tooth 12 ensures the position of the part 10 with respect to the Y axis. The rear part 11 of the coils is then adjusted against the rear of the substantially cylindrical separator, the whole assembly then being held in position by surrounding the parts 11 with an adhesive 15. The two coils are separated by an edge 14 extending in the YZ plane. Disadvantageously, the adjustment of the position of the coils, before the phase of adhesively bonding them to the body of the separator, may be modified, when handling the pre-adjusted deflection yoke. The adjustment may be modified either by rotation of the front part 10 about the z axis, with a maximum angle 16, which depends on the shapes of the coils and on the permitted tolerances, or by movements of the rear part 11 in the XY plane, the manufacturing tolerances leaving a gap 17 between the internal surface of rear part 11 and the surface of the separator. Moreover, the above two problems may combine to modify the initial adjustment of the position of the coils.

In order to prevent these movements, the deflection yoke, according to the invention, has a separator whose particular feature is that of possessing, on at least one of its surfaces, an arrangement for positioning a pair of deflection coils and for holding them in position. This arrangement ensures that the initial adjustment of the coils is maintained until the phase of adhesively bonding the coils to the separator. This arrangement is produced by moulding the material of the separator during production of the latter, and therefore does not require the use of an additional adhesive or an additional component.

Figure 4:
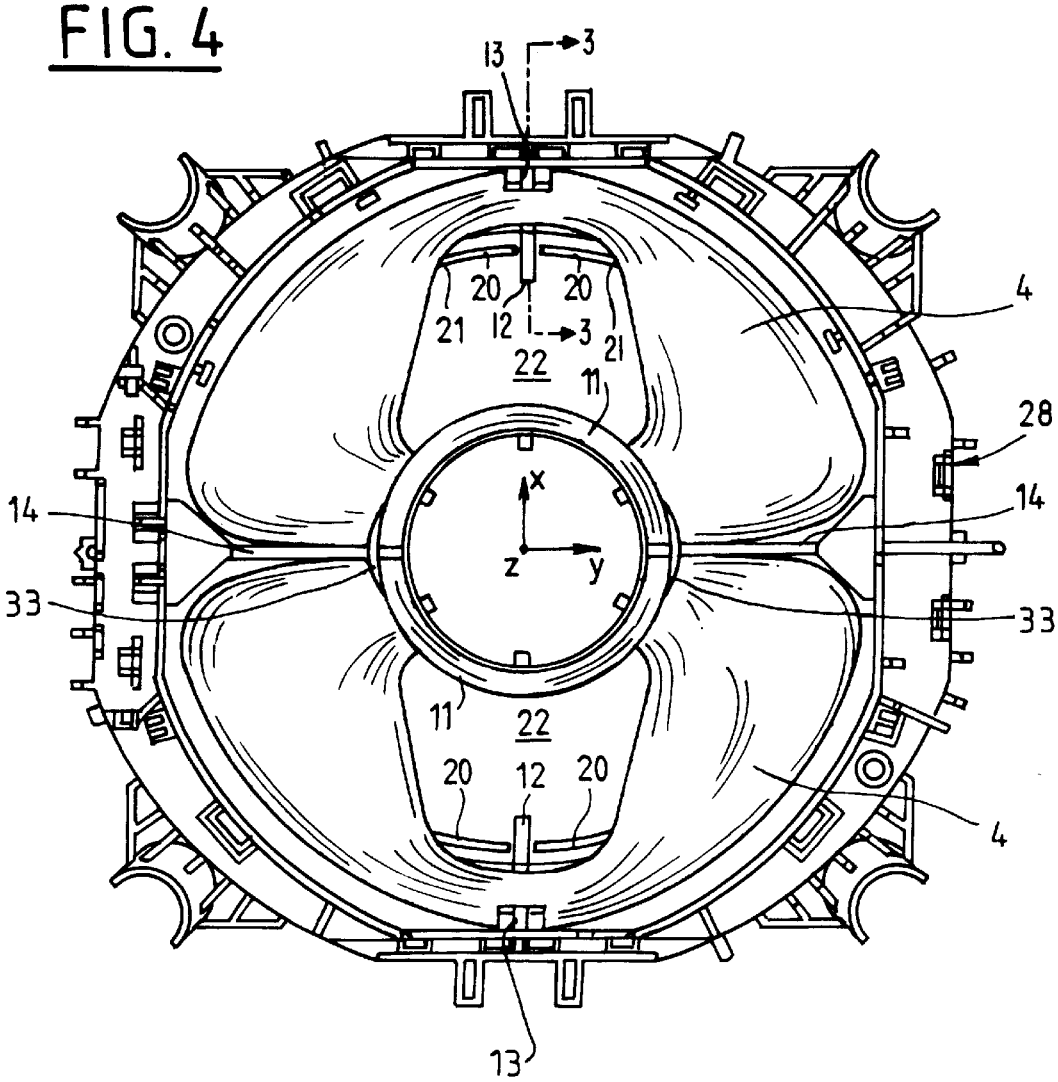
FIG. 4 illustrates a deflection yoke according to the invention, seen from the rear.
Figure 8:
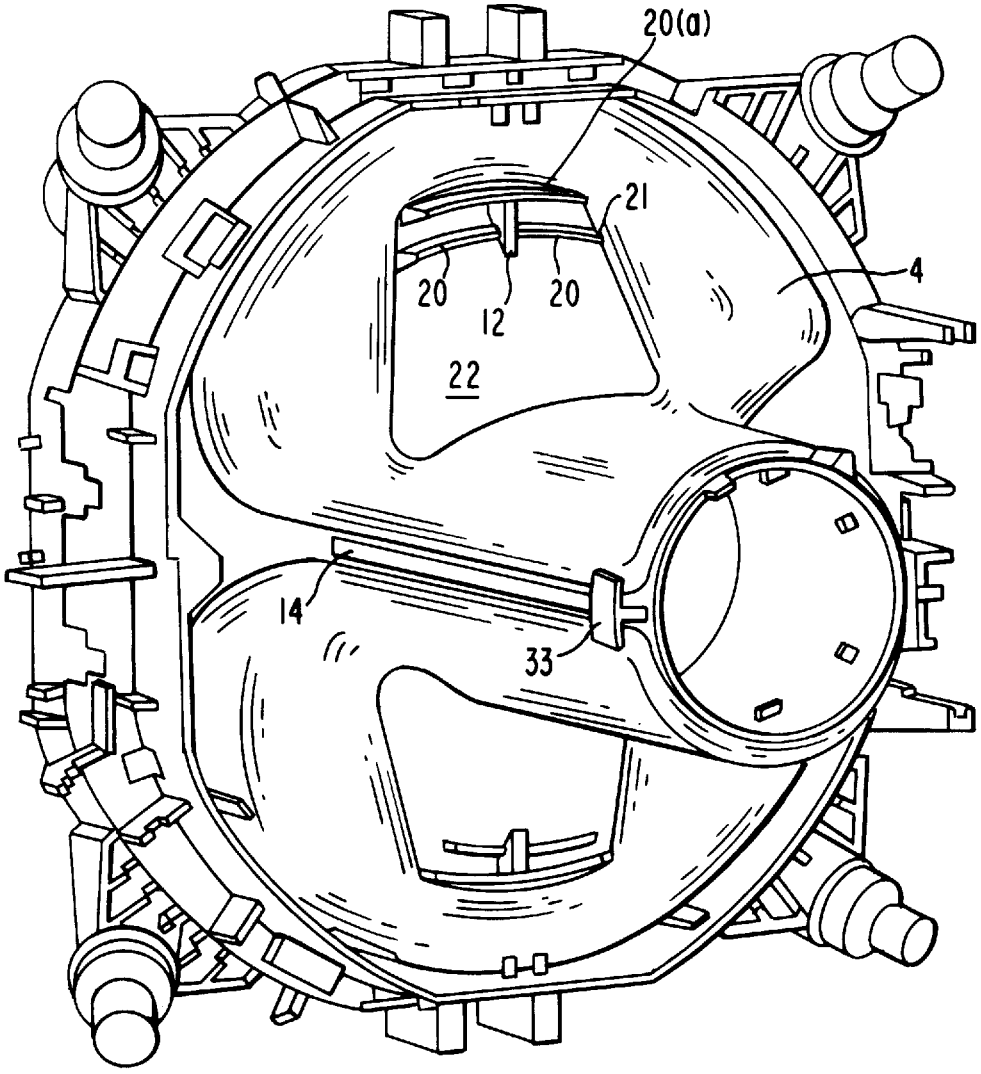
FIG. 8 illustrates a separator, in accordance with an inventive feature, shown in perspective view.

In one embodiment, as illustrated by FIG. 4, the front part is prevented from rotating about the Z axis and from changing its position along the Y axis by projecting members or ribs 20 of FIGS. 8 and 4 projecting from the surface of the separator 28 and extending between a pair of conductor bundles that form a winding window 22. The pair of conductor bundles extend longitudinally in the general direction of the Z axis. Whereas, ribs 20 extend laterally between the pair of conductor bundles. Ribs 20 extend in such a way that they each come, at at least one point 21, into contact with the coils that extend longitudinally in the conductor-free internal winding window 22. Similar symbols and numerals in FIGS. 1–4 and 8 indicate similar items or functions.

Rib 20 of FIG. 4 and 8 may be formed by a pair of rib portions 20*a* having a gap, such as where tooth 12 is located, between the rib portions. FIG. 8 shows an example of a given rib 20(*a*) having a unitary construction extending over the surface of the separator so that its ends come into contact with the coil in the conductor-free window of the coil. Thus, rib 20(*a*) having a unitary construction does not include a gap.

The final design of the deflection coils goes through iterative steps, for example in order to modify the convergence of the electron beams onto the screen of the tube perfectly. In order to introduce these modifications, if necessary, without having to modify the mould for manufacturing the separators, this would being extremely expensive to manufacture, it is normal to modify the geometrical winding distribution of the conductors of the coil, which involves modifying the shape of the internal winding window of the coil.

It should be pointed out that the iterative operations could involve geometrical modifications of the internal windows of the coils lying more in their central or rear part without it being necessary to modify the part lying to the front of the separator, that is to say its more flared part.

As a result, a given rib 20 of FIG. 4 or 8, used for preventing rotation of the front of the coils, is preferentially arranged on the surface of the separator so as to come into contact with the coils in that part of the window lying close to the front of the separator. Thus, the designer will be able to introduce modifications in the conformation of the fields by modifying the winding distribution in the intermediate and rear part of the coil. Thus, advantageously, it would not be necessary to vary the position of rib 20 on the body of the separator located at the front and, therefore, there would be no need to produce a new mould in order to manufacture the separator.

In carrying out another inventive feature, in order to immobilize those parts of the coils which lie on the substantially cylindrical rear part 11 of the separator, housings are produced by moulding so that the edges of the coils are engaged under a slight constraining pressure in these housings.

Figure 5:
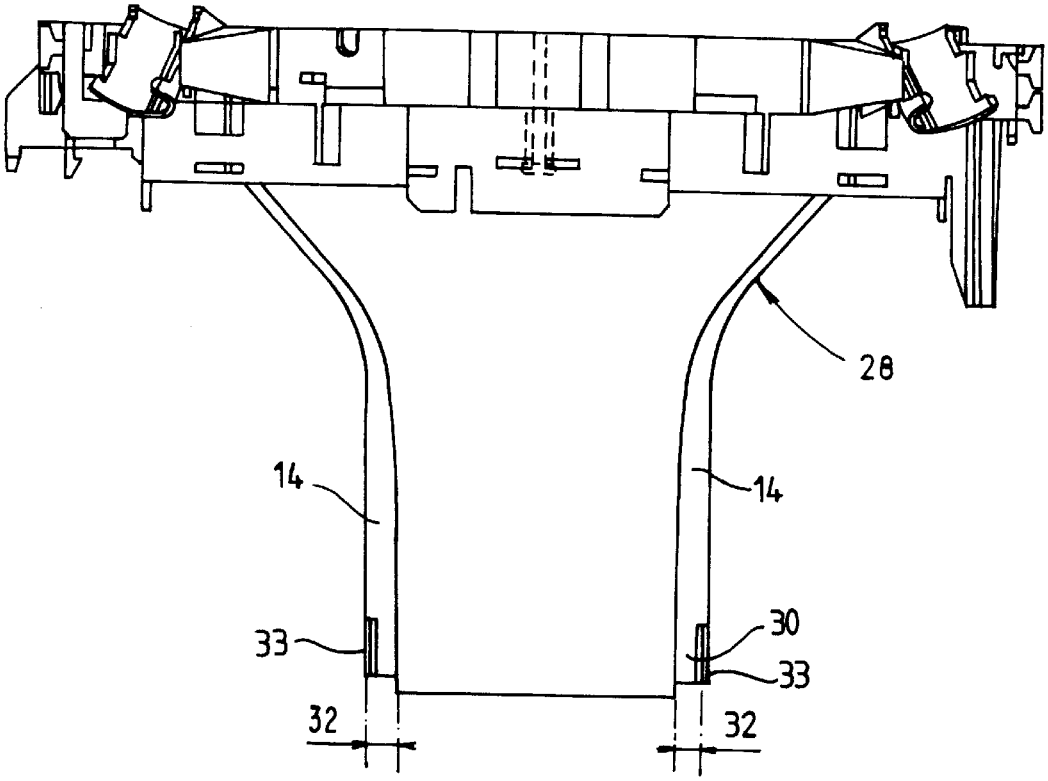
FIG. 5 illustrates a side view of a separator according to the invention.
Figure 6:
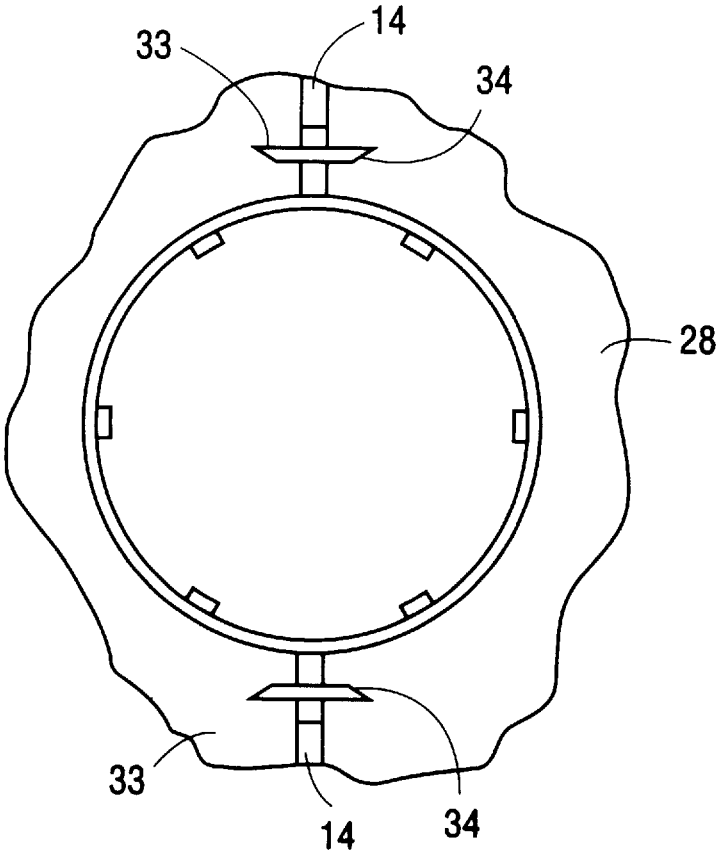
FIG. 6 illustrates a detail of the substantially annular rear part of the separator, according to the invention.

In the example illustrated by FIGS. 5 and 6, the edge 14 separating the vertical deflection coils has a rear part 30 that is shaped so as to produce a substantially plane wall 33 parallel to the XZ plane. Similar symbols and numerals in FIGS. 1–8 indicate similar items or functions.

The end 34 of FIG. 6 of the wall is bevelled so as to make it easy to insert the rear part of the deflection coil into the space or housing formed between the wall 33 and the surface of the separator. This wall lies at a distance 32 from the surface of the separator. This distance is approximately equal to the thickness of the coil which is intended to be housed thereunder. This wall may extend on either side of each of the edges 14 to form a T-shaped member. In this way, the rear part of the coils 4 will be housed so as to be constrained under these walls 33 which will hold them in their position along the X and Y axes until the adhesive bonding step.

Figure 7:
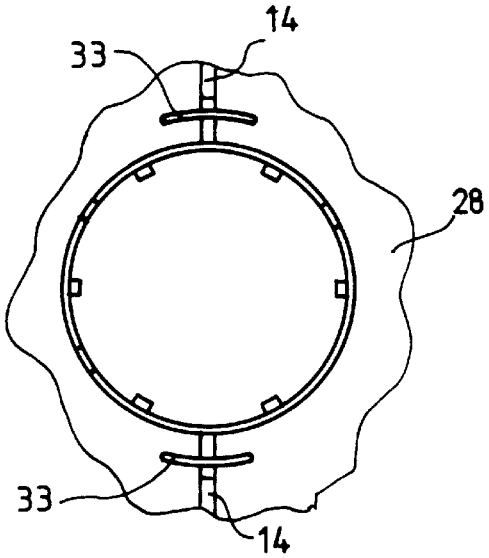
FIG. 7 illustrates in detail the substantially annular rear part of the separator according to an alternative embodiment of the invention.

In another embodiment, shown in FIGS. 7 and 8, the rear part of the edge 14 is shaped so as to produce a curved wall 33 substantially parallel to the cylindrical surface of the separator. The curved shape of these walls is designed to prevent the coils, because of reaction to the constraint, from escaping, during handling, the housing in which they have been inserted.

The embodiments described hereinabove are not limiting; thus, several parts of each of the edges 14 may be shaped in order to form several walls 33; likewise, the means described for positioning the vertical deflection coils and holding them in place are, in the same way, adapted to horizontal deflection coils on condition that they are arranged on the internal surface of the separator.

What is claimed is:

1. A deflection yoke for a cathode ray tube, comprising:

a first pair of saddle shaped deflection coils, a given coil thereof having a pair of conductor bundles extending between a rear end and a front end of said deflection yoke and forming a winding window therebetween free of conductors;

a second pair of deflection coils for producing a deflection field having a direction that is different from that produced by said first pair of deflection coils;

a magnetic core magnetically coupled to said deflection coils; and a separator for separating said first and second pairs of deflection coils having a surface for supporting said first pair of deflection coils and including a projecting member extending laterally between said pair of conductor bundles, projecting from said surface and being received in said winding window in a manner to engage in a lateral direction a conductor bundle of said pair of conductor bundles of said given coil of said first pair of deflection coils.

2. A deflection yoke according to claim 1 wherein said projecting member is formed in the same mould as a body of said separator.

3. A deflection yoke according to claim 1 wherein said projecting member comprises a pair of rib portions separated by a gap therebetween.

4. A deflection yoke according to claim 1 wherein said projecting member engages each of said pairs of conductor bundles in a manner to avoid a change in position of said coil of said first pair of deflection coils.

5. A deflection coil according to claim 1 wherein said projecting member is positioned closer to a front end than to an intermediate portion of said given coil.

6. A deflection yoke for a cathode ray tube, comprising:

a first pair of saddle shaped deflection coils, a given coil thereof having a pair of conductor bundles extending between a rear end and a front end of said deflection yoke;

a second pair of deflection coils for producing a deflection field having a direction that is different from that produced by said first pair of deflection coils;

a magnetic core magnetically coupled to said deflection coils; and a separator for separating said first and second pairs of deflection coils having a surface for supporting said first pair of deflection coils and including a wall spaced from said surface of said separator and forming an integral part of a rear portion of said separator for receiving a rear portion of at least one of said first pair of deflection coils between said wall and said surface at said rear portion.

7. A deflection yoke according to claim 6 wherein said wall is attached to an edge of said separator that separates one of the coils of said first pair of deflection coils from one of the coils of said second pair of deflection coils.

8. A deflection yoke according to claim 7 wherein said wall is attached to said edge by a moulding process.

9. A deflection yoke according to claim 6 wherein said wall has a bevelled end.

10. A deflection yoke according to claim 6 wherein said wall is curved.

11. A deflection yoke for a cathode-ray tube, comprising:

a pair of vertical deflection coils;

a pair of horizontal deflection coils, at least one pair of these two pairs being saddle-shaped;

a rigid separator insulating the two pairs of deflection coils from each other;

a core made of ferromagnetic material of substantially frustoconical shape arranged above at least part of the deflection coils; and means for positioning the coils of said one pair and for holding them in place against a body of the separator both on a front part and on a rear part of said one pair, said coils positioning means forming an integral part of the body of the separator.

12. A deflection yoke according to claim 11, wherein said coils positioning means is produced during the moulding of the body of the separator.

13. A deflection yoke according to claim 12, wherein said coils positioning means comprises at least two projecting members intended to extend into a conductor-free internal window of the coil.

* * * * *